United States Patent [19]

Mizunuma

[11] Patent Number: 4,773,643

[45] Date of Patent: Sep. 27, 1988

[54] PICTURE MATCHING GAME

[75] Inventor: Masanori Mizunuma, Tokyo, Japan

[73] Assignee: Tomy Kogyo Co., Inc., Tokyo, Japan

[21] Appl. No.: 151,496

[22] Filed: Feb. 2, 1988

[30] Foreign Application Priority Data

Jun. 2, 1987 [JP] Japan ..... 62-16149[U]

[51] Int. Cl.[4] ..... A63F 9/00

[52] U.S. Cl. ..... 273/1 GE

[58] Field of Search ..... 273/1 G, 1 GE, 1 GG, 273/143; 434/402

[56] References Cited

U.S. PATENT DOCUMENTS

| | | | |
|---|---|---|---|
| 442,683 | 12/1890 | Kennedy, Jr. et al. | 273/143 R |
| 1,064,576 | 6/1913 | Washburn | 273/155 |
| 3,462,857 | 8/1969 | Glass et al. | 434/402 |
| 3,784,197 | 1/1974 | Massicotte | 273/143 R |
| 3,841,628 | 10/1974 | Goldfarb | 273/1 GE |

*Primary Examiner*—Paul E. Shapiro

*Attorney, Agent, or Firm*—Staas & Halsey

[57] ABSTRACT

A picture matching game includes a display box and three rotating members rotatable in the display box. Each rotating member has three display surfaces, any one display surface being stopped in a display position, and the three rotating members being stopped with three display surfaces in display positions to jointly form a display pattern. All possible display patterns are printed on playing cards, which are scattered face up before playing. When the rotating members are stopped and a display pattern is displayed, players reach for and take a card which matches the displayed pattern, the fastest player being the one to take the card.

12 Claims, 3 Drawing Sheets

PICTURE MATCHING GAME

BACKGROUND OF THE INVENTION

1. Field of the Invention

This invention relates generally to amusement devices and more particularly to a picture matching game having a picture pattern displaying machine on which picture patterns are randomly displayed, and playing cards having picture patterns theron which are matched to the machine displayed picture patterns.

2. Description of the Related Art

A machine in which picture patterns are matched at random is disclosed in Japanese Utility Model Publication No. Sho 54 (1979)-42777. In this conventional technique, line patterns are displayed on the polyhedron of a triangle column. When one knob is operated, a rack engages with a pinion of the polyhedron to rotate it and when another knob is operated, an engagement plate determines the stop position of the polyhedron. These line patterns displayed on the various faces of the polyhedron are constructed to be joined at the respective faces.

SUMMARY OF THE INVENTION

The present invention is an improvement in which an apparatus is used to match the various picture patterns at random in order to carry out a picture matching game using the matched picture patterns in a manner similar to that of the Japanese card game Karuta.

The invention improves upon devices previously described. In the present invention, a picture pattern displaying device has a plurality of rotary members which are rotatably supported thereon and a front opening portion having a plurality of matchable picture patterns. The rotary members are cooperatively coupled with a rotary force generating member storing driving force when a push button formed on the picture pattern displaying machine is pushed and stopped when it engages a stop mechanism of the rotary member. The picture pattern displaying device has a plurality of picture cards displaying all picture patterns matchable to the picture patterns displayed on the display face.

In playing the game, a plurality of picture cards are randomly arranged in front of the picture pattern displaying device and the rotary member is rotated when the push button on the picture pattern displaying device is pushed. When the rotary members are stopped, the picture cards depicting the same patterns as that displayed on the display front face of the rotary member are taken by opposing players on the basis of first-come/first-serve.

The faster player will win by taking more cards than the opposing player or players.

DETAILED DESCRIPTION OF THE PREFERRED EMBODIMENTS

Figure 1:
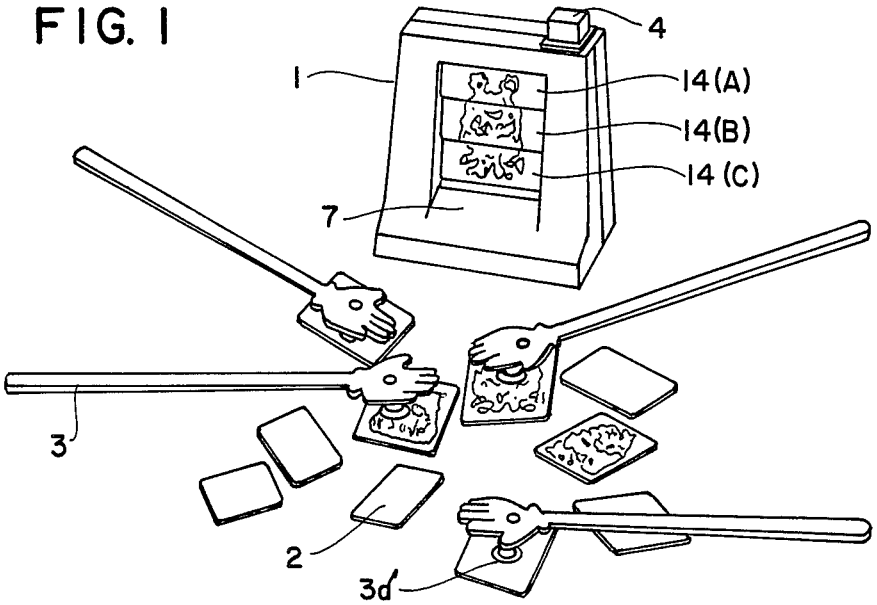
FIG. 1 is a perspective view of the preferred embodiment.

Referring now to FIGS. 1–5, a picture displaying box 1 is vertically oriented and has a wide bottom portion for improving stability. A front opening 7 has rotary members 14(A), 14(B), 14(C) rotatably arranged therein. A push button 4 is placed in and extends through a through-hole 1*b* formed in a top wall of the picture pattern display box 1. In front of the picture pattern display box 1, a plurality of picture cards 2 displaying all picture patterns matchable to patterns displayed on the display face of the rotary members 14(A), 14(B), and 14(C) are randomly arranged. A suction bar 3 is held in the hand of a player in order to take a picture card 2 by gripping with a suction portion 3*a* attached on the end of the bar 3.

Figure 2:
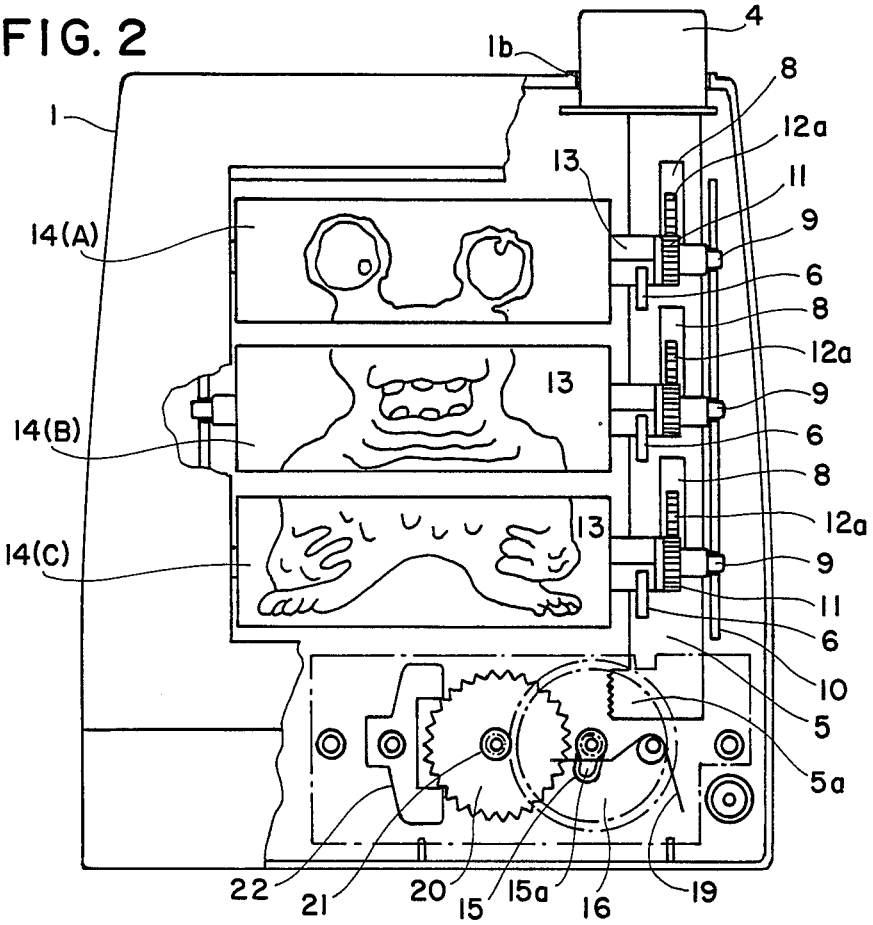
FIG. 2 is a front view, partly cut-away, showing a part of the picture pattern display device of the FIG. 1 embodiment.
Figure 3:
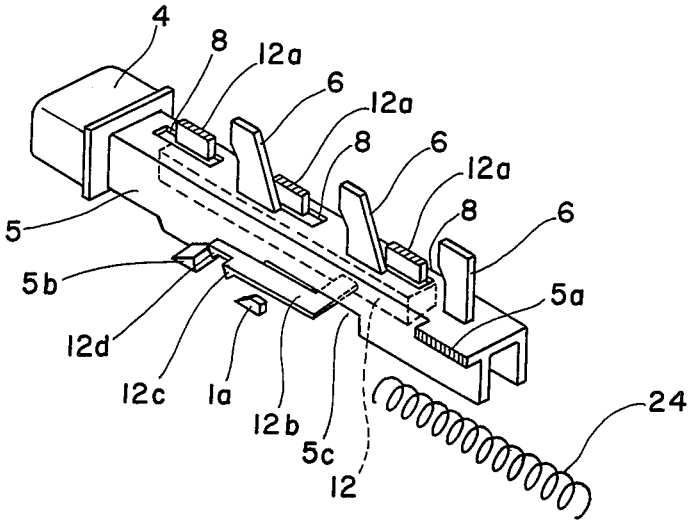
FIG. 3 is a perspective view showing the sliding lever and the sliding member of the FIG. 1 embodiment.

As shown in FIGS. 2 and 3, a sliding lever 5 is integrally formed on the lower portion of the push button 4. This sliding lever 5 has a sectional shape of ]-character and the interior of the lever 5 has a sliding member 12 which is slidably arranged therein. At the side of the sliding lever 5, there are three grooved holes 8 formed thereon through which three projections formed on the sliding member 12 extend. Racks 12*a* are formed at the upper edges of the projections and are fitted through the grooved holes 8. Three engagement projections 6 are positioned on the lever 5 positions slightly lower than the positions of the grooved holes 8. An engagement projection 5*b* is provided at the side wall of the sliding lever 5. A cut-out portion 5*c* is formed under the engagement projectors 5*b*. A L-shaped spring or elastic member 12*b* extends outwardly from the sliding member 12 through the cut-off portion 5*c* and a bent portion extends upwardly along the side wall of the sliding lever 5. The front end of the elastic member 12*b* is divided into two portions, one longer and the other shorter. Projection 12*c* is provided at the shorter end portion and projection 12*d* at the longer end portion. The projection 12*d* formed on the long end is engageable with an engagement projection 5*b* formed on the sliding lever 5 and the other projection 12*c* formed on the short end is engageable with an engagement slant face of a release projection 1*a* formed on the inner wall of the picture pattern display box 1 to bend or deflect the end of the elastic member 12*b* and to release the engagement of the engagement projection 5*b* to another projection 12*d*.

The lower end of the sliding member 12 is free and has a shape able to fit into the partition wall 5*d* formed on the sliding lever 5 and a ]-character-shaped frame of the sliding lever 5. A compression spring 24 is compressed in the space between the wall 1*c* formed on the inner wall face of the picture pattern display box 1, and partition wall 5*d*. The spring 24 always biases or pushes the sliding lever 5 upwardly. Another compression spring 23 is compressed in the space between the end inner wall 12*e* of the sliding member 12 inserted into the sliding lever 5 and the erected wall 1*b* formed on the inner wall of the picture pattern display device 1. The compression spring 23 always biases or pushes the sliding member 12 upwardly.

The rotary bodies 14(A), 14(B), and 14(C) each have the shape of a polyhedron and small shafts 9 are rotatably supported on the bearing plate 10. Pinions 11 are mounted on the small shafts 9. Polyhedron shafts 13 triangular in cross-section are formed on the sides of pinions 11.

Figure 4:
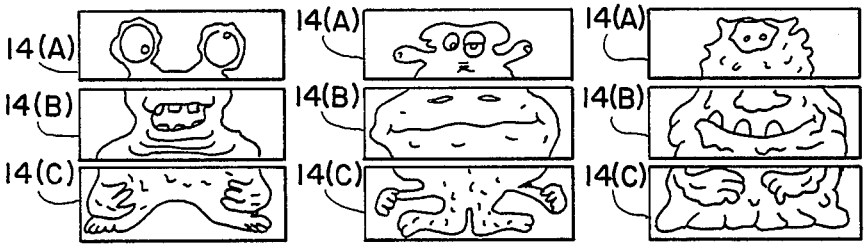
FIG. 4 is a plan view showing the picture pattern displayed on the display faces of the rotary bodies of the FIG. 1 embodiment.
Figure 5:
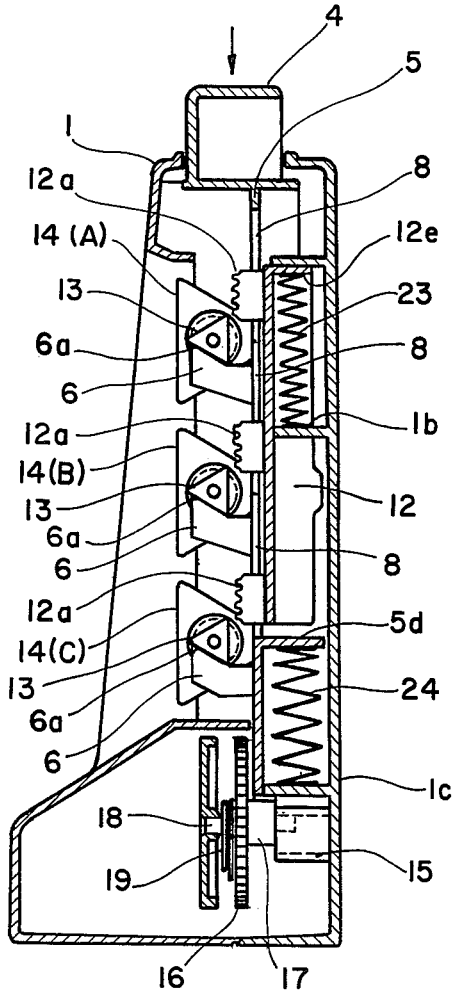
FIG. 5 is a longitudinal sectional view showing the construction of the picture pattern display device.

The displaying face, being formed by respective faces of the rotary bodies 14(A), 14(B), and 14(C) displays the picture patterns displayed in FIG. 4. That is, on the display face of the upper rotary body 14(A), three alternative picture patterns are displayed. Similarly, three alternative patterns are displayed on the three surfaces of rotary member 14(B) and 14(C).

When the picture pattern display box 1 is actuated by pushing downwardly on push button 4, the sliding lever 5 is moved vertically against the force of the spring 24. At this time, the engagement projection 5*b* formed on the sliding lever 5 is engaged with the other projection 12*d* formed at the end of the spring clip member 12*b* of the sliding member 12 to move downwardly the sliding member 12 against the force of the pressing spring 23. When the sliding lever 5 is moved downwardly, a rack 5A formed on the lower end of the sliding lever 5 engages with the small gear 17 on the gear shaft 18 to move the gear shaft 18 downwardly in the oval hole 15*a* of the bearing member 15. Owing to this downward movement of the gear shaft 18, the gear 16 and a small gear 21 are separated and so that the governor mechanism constructed with a ratchet wheel 20 and oscillating pawl member 22 is not moved. As a result, the sliding lever 5 easily moves down and a driving force against the pushing springs 24, 23 is stored.

When the sliding lever 5 reaches a predetermined lower most position, the projection 12*c* formed at the end of the spring clip member 12*b* rides on the engagement slant face of the release projection 1*a* to deflect the end of the elastic member 12*b*, resulting in a release of the engagement between the projection 12*d* and the engagement projection 5*b*. After disengagement of the engagement projection 5*b* to the projection 12*d*, the sliding member 12 is suddenly moved up by means of an elastic force of the pushing spring 23, so that the rack 12*a* engages to the pinions 11 of the rotary bodies 14(A), 14(B), 14(C) to rotate these rotary bodies 14(A), 14(B), 14(C). That is, the sliding member 12 and the pushing spring 23 constitute a rotary driving force mechanism for the rotary bodies 14(A), 14(B), 14(C).

When the downward pressing force on the push button 4 is released, the sliding lever 5 moves upward by the elasticity force of the pushing spring 24 to engage the rack 5*a* formed on the lower end to the small gear 17, the gear 16 moved upwardly by the elasticity force of the spring 19 engages to the small gear 21 on the same shaft as that of the claw wheel or ratchet wheel 20, so that they are slowly move up by means of the governor mechanism of the oscillating pawl member 22 engaged with the ratchet wheel 20 and moved oscillately. The rotary bodies 14(A), 14(B), 14(C) rotate sufficiently until the rack 5*a* is separated from the small gear 17, whereupon the sliding lever 5 suddenly moves upwardly. Then, the engagement faces 6*a* formed on the upper ends of the engagement projections 6 formed on the sliding lever 5 engages with one of the polyhedron shafts 13 to stop the rotary motions of the rotary bodies 14(A), 14(B), 14(C). As a result, the sliding lever 5, the engagement projections 6, and the pushing spring 24 constitute a rotation stoppage mechanism for the rotary bodies 14(A), 14(B), 14(C). When the polyhedron shafts 13 are stopped by the engagement projections 6 the display the display faces of the rotary bodies 14(A), 14(B), 14(C) are always set to face to the front of the opening 7 of the picture pattern display box 1.

The number of the kind of the picture pattern matching displayed on the three rotary bodies 14(A), 14(B), 14(C) having three display faces is twenty seven (27) and so twenty seven (27) picture cards 2, respectively displaying the picture pattern corresponding to the picture patterns above are prepared. This is due to the fact that the displayed picture is made of three parts, each part having three possible selections. With a one in three chance of any given picture pattern being displayed, the number of possible combinations will be $3^3$ or 27. With four rotary members and three choices, the number of possible combinations would be $4^3$ or 64. Variations in numbers of rotary members and polyhedron surfaces will fall within the present invention, although the perferred embodiment uses three rotary members with each having three surfaces.

When the push button provided on the picture display device is actuated, the rotary bodies displaying picture patterns on their display faces rotate for a predetermined time duration and then stop. The picture cards displaying the same picture pattern as that displayed on respective face of the rotary bodies are competitively taken by the players. This picture matching game according to the present invention can be enjoyed even by preschool children.

I claim as my invention:

1. A picture matching game comprising, a picture pattern display box, a plurality of rotary members provided in a front opening portion of the displaying box and having a plurality of displaying faces displaying matchable picture patterns, said rotary members being rotatably mounted in said picture pattern display box, rotary motion means for providing a driving force to the rotary members when a push button placed on said picture pattern displaying device is pushed, said rotary members rotating cooperatively with said rotary motion means, and a plurality of picture cards showing all picture patterns matchable to the displaying faces of the rotary members.

2. A picture matching game as claimed in claim 1 wherein the plurality of rotary members comprises three rotary members, each being a polyhedron having three display surfaces.

3. A picture matching game comprising, a picture pattern display box, a plurality of rotary members rotatably supported in the picture pattern display box, each rotary member having plural display surfaces, and each display surface having a portion of a picture pattern thereon, rotary motion means, connectable to the rotary members, for imparting rotary motion to the rotary members, stop means for stopping each rotary member so that one of the display surfaces for each rotary member faces outwardly, each display surface being randomly stopped by the stop means thereby randomly generating one of plural picture patterns made from the combined display surfaces of the individual rotary members, and a plurality of picture cards showing picture patterns matchable to the plural randomly generated picture patterns, whereby game players match displayed picture patterns to picture cards.

4. A picture matching game as claimed in claim 3 further comprising, a governor connected to the stop means and being operable to determine a time period for rotation.

5. A picture matching game as claimed in claim 3 further comprising a plurality of hand-held implements for use by game players to extract a picture card immediately upon display of the picture card picture pattern by the picture pattern display box.

6. A picture matching game as claimed in claim 3 wherein the rotary motion means comprises, a sliding lever formed on a lower portion of a push button, the sliding lever carrying a sliding element having a rack engageable with the rotary members.

7. A picture matching game as claimed in claim 6 wherein the sliding lever carries the stop means and, wherein the stop means comprise a plurality of engagement projections provided on the sliding lever, each being engageable with a corresponding rotary member to randomly stop the corresponding rotary member in a display position.

8. A picture matching game as claimed in claim 7 further comprising, a governor connectable to the sliding lever to hold the engagement projections in a disengagement position for a predetermined time period while the sliding lever moves upwardly to a predetermined position, whereby after reaching the predetermined position, engagement of the sliding lever to the governor is released and the engagement projections move further upwardly to stop the rotary members.

9. A picture matching game as claimed in claim 8 wherein the governor comprises, a ratchet wheel and oscillating pawl rotatable by a gear engageable with the ratchet wheel upon upward movement of the sliding lever.

10. A picture matching game as claimed in claim 9 wherein the rotary members are rotatable about a horizontal axis and comprise lower, middle and upper rotary members.

11. A picture matching game as claimed in claim 10 wherein the lower rotary member has three display surfaces for displaying three different lower portions of a picture pattern, the middle rotary member has three display surfaces for displaying three different middle portions of a picture pattern, and the upper rotary member has three display surfaces for displaying three different upper portions of a picture pattern, wherein the lower middle and upper rotary members are stopped to randomly display three lower middle and upper display surfaces which together constitute a picture pattern matchable to one of the picture cards.

12. A picture matching game as claimed in claim 6, wherein the sliding element is detachably connected to the sliding lever when moved downwardly and disconnected from the siding lever when moved upwardly.

* * * * *

UNITED STATES PATENT AND TRADEMARK OFFICE

CERTIFICATE OF CORRECTION

PATENT NO. : 4,773,643

DATED : September 27, 1988

INVENTOR(S) : MASANORI MIZUNUMA

It is certified that error appears in the above-identified patent and that said Letters Patent is hereby corrected as shown below:

Title page:

[30] "Jun. 2, 1987" should be --Feb. 6, 1987--.

Column 3, line 66, delete "the display".

Signed and Sealed this

Seventh Day of March, 1989

*Attest:*

*Attesting Officer*

DONALD J. QUIGG

*Commissioner of Patents and Trademarks*